US005339982A

United States Patent [19]

Tardie

[11] Patent Number: 5,339,982

[45] Date of Patent: Aug. 23, 1994

[54] CANTEEN FOR CHILDREN

[75] Inventor: Pierre Tardie, Longueuil, Canada

[73] Assignee: Genin Trudeau, Quebec, Canada

[21] Appl. No.: 28,537

[22] Filed: Mar. 8, 1993

[51] Int. Cl.[5] ..... B67D 3/00

[52] U.S. Cl. ..... 220/708; 220/709; 215/229

[58] Field of Search ..... 220/705, 708, 254, 709, 220/428; 215/229, 1 A, 230

[56] References Cited

U.S. PATENT DOCUMENTS

| | | | |
|---|---|---|---|
| 3,489,307 | 1/1970 | Wenger | 215/230 |
| 4,444,328 | 4/1984 | Glass | 215/230 |
| 4,941,590 | 7/1990 | Pantaleo et al. | 220/428 |
| 5,065,909 | 11/1991 | Pino et al. | 215/229 X |
| 5,150,815 | 9/1992 | Saklad | 215/229 X |

*Primary Examiner*—Joseph Man-Fu Moy
*Attorney, Agent, or Firm*—Michael Ebert

[57] ABSTRACT

A canteen for children whose structure incorporates a drinking straw that also functions as a stopper. The canteen includes a cylindrical container for the liquid to be dispensed and a removable cover which is screwed onto the rim of the container and is provided with an off-center coupler. One end of the coupler projects from the underside of the cover to form a lower nipple to which is attached a long dip tube that extends into the container. The other end of the coupler projects from the top side of the cover to form an upper nipple to which is attached a short, flexible mouth tube, which in combination with the dip tube functions as a drinking straw. Mounted over the cover is a dome having a slot therein, the dome being turnable with respect to the cover from a drinking mode position in which the mouth tube then projects upwardly through the slot, to a sealing mode position in which the mouth tube is bent under the dome and is pinched at the bend so that it now acts as a stopper to seal the container.

9 Claims, 3 Drawing Sheets

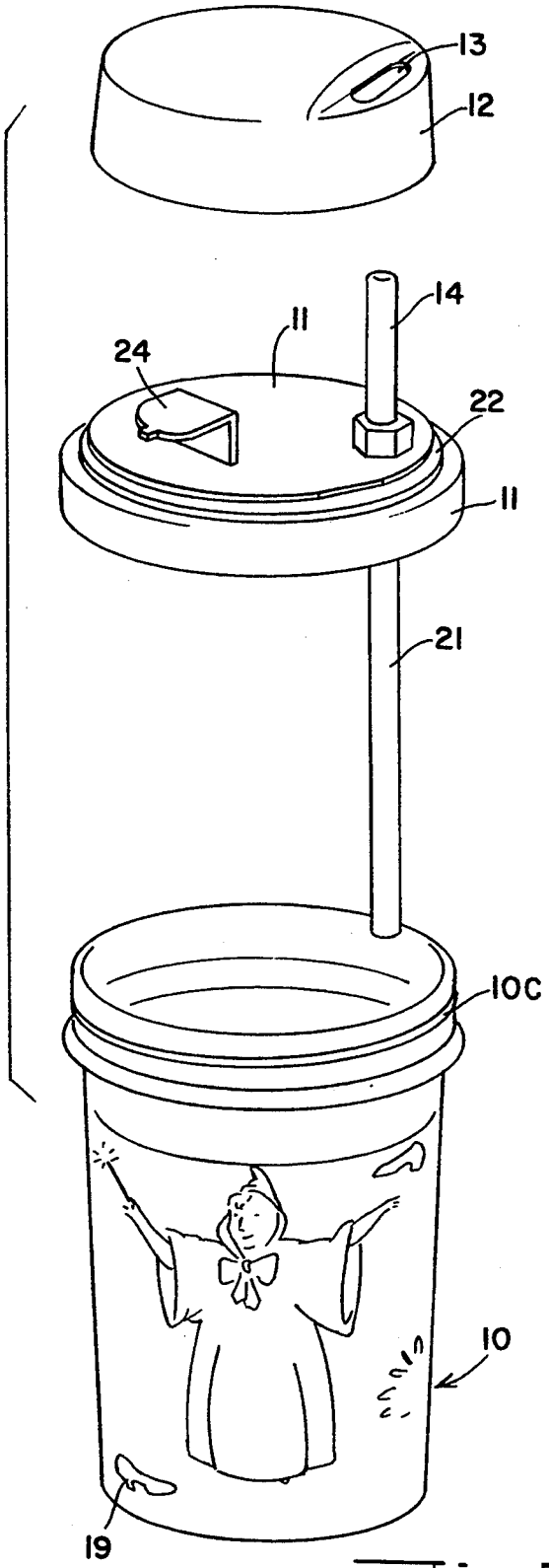
Fig. 7
Fig. 8
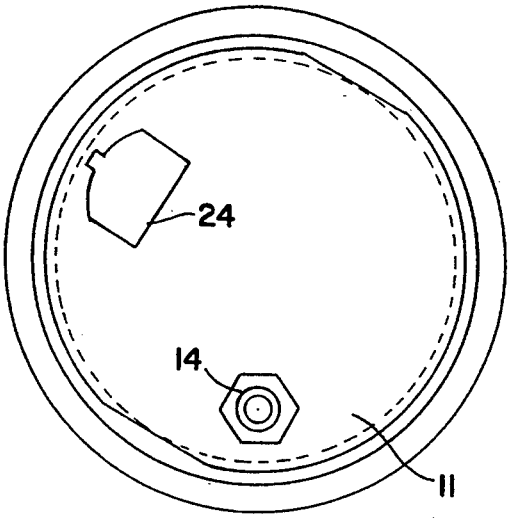
Fig. 9
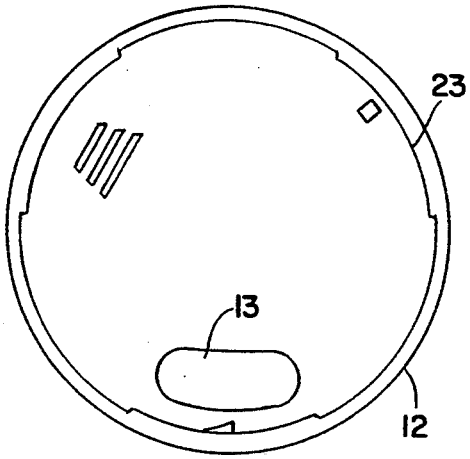

CANTEEN FOR CHILDREN

BACKGROUND OF INVENTION

1. Field of Invention

This invention relates generally to canteens for carrying drinkable liquids, and more particularly to a canteen for young children which incorporates in its structure a drinking straw that also functions as a stopper.

2. Status of Prior Art

A canteen is a flask for carrying drinking water or other drinkable liquids. Its origin is the French word cantine, which is derived from the Italian "cantina," meaning a wine cellar.

Canteens are now commonly used by hikers and others to carry drinking water. Usually a canteen takes the form of a metal or plastic flask having a removable screw cap. These are not suitable for pre-school or very young children; for in order to drink from a conventional canteen, the child must unscrew the cap, which is usually chained to the flask, and then put the threaded neck of the flask into his mouth. Since the flask is filled with liquid and is fairly heavy, a young child runs the risk of hitting and damaging his teeth with the hard, threaded neck of the flask.

While it is the usual practice for children to use straws to drink from a soda bottle or juice carton, it is not feasible for children to use straws to drink from a conventional canteen. Also, pre-school children may find it difficult to unscrew the cap from a conventional canteen and to screw it back firmly in place so that the water does not then leak from the canteen.

Moreover, a conventional canteen is strictly utilitarian in appearance and unattractive to young children. Yet some children, even though they may not be thirsty, must be induced to drink. Thus in a hot, dry climate, it is important for a child to drink frequently to avoid dehydration and its consequences.

We have found that when a canteen is an attractive plaything, a child enjoys playing with it before and after drinking; hence the child will drink frequently as part of his play activity.

SUMMARY OF INVENTION

In view of the foregoing, the main object of this invention is to provide a canteen for children that incorporates in its structure a straw, making it possible for the child to siphon liquid from the canteen and also functioning as a stopper therefor, thereby obviating the need to remove a cap to drink and to screw back the cap to seal the canteen.

Also an object of this invention is to provide a canteen of the above type which is also capable of functioning as a plaything so as to induce a child to make frequent use of the canteen to drink the liquid contained therein.

More particularly, an object of this invention is to provide an attractive canteen of the above type whose container is formed by concentric inner and outer shells of transparent plastic material which define a closed chamber filled with a carrier liquid having decorative particles dispersed therein, these being animated when the canteen is shaken to produce a dynamic display.

A significant feature of the invention is that the dynamic display created by shaking the canteen is related to the theme of a story or fairy tale, the main characters of which are graphically illustrated on the inner shell of the container and are visible through the outer shell.

Yet another object of the invention is to provide an attractive canteen of the above type which is also a plaything and induces a child who plays with the canteen to drink therefrom.

Briefly stated, these objects are attained in a canteen for children whose structure incorporates a drinking straw that also functions as a stopper. The canteen includes a cylindrical container for the liquid to be dispensed and a removable cover which is screwed onto the rim of the container and is provided with an off-center coupler. One end of the coupler projects from the underside of the cover to form a lower nipple to which is attached a long dip tube that extends into the container. The other end of the coupler projects from the top side of the cover to form an upper nipple to which is attached a short, flexible mouth tube, which in combination with the dip tube functions as a drinking straw. Mounted over the cover is a dome having a slot therein, the dome being turnable with respect to the cover from a drinking mode position in which the mouth tube then projects upwardly through the slot, to a sealing mode position in which the mouth tube is bent under the dome and is pinched at the bend so that it now acts as a stopper to seal the container.

BRIEF DESCRIPTION OF DRAWINGS

For a better understanding of the invention as well as other objects and further features thereof, reference is made to the following detailed description to be read in conjunction with the accompanying drawings, wherein:

FIG. 7 is an exploded view of the container;

FIG. 8 is a top view of the cover; and

FIG. 9 is a bottom view of the dome.

DESCRIPTION OF INVENTION

Figure 1:
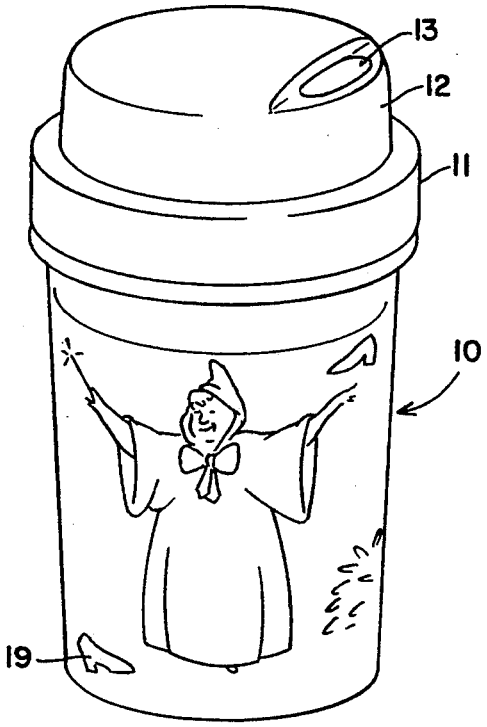
FIG. 1 is a perspective view of a canteen in accordance with the invention formed by a cylindrical container having a removable cover provided with a dome that is turnable with respect to the cover from a drinking mode to a sealing mode position, the canteen being shown in its sealing mode.
Figure 2:
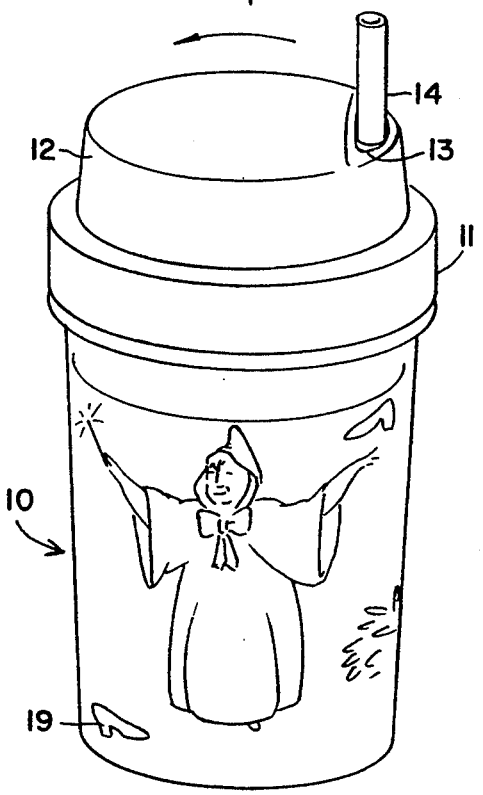
FIG. 2 shows the canteen, in perspective, in its drinking mode.

Referring now to FIGS. 1 to 9, a canteen in accordance with the invention includes a cylindrical container, generally designated by reference numeral 10, serving as a receptacle for a pint or so of drinking water or other drinkable liquid. In practice, the canteen may be made in any scale suitable for children.

Screwed onto the rim of container 10 is a circular cover 11 in a cap format, above which is rotatably mounted a dome 12 having an off-center slot 13 which is adjacent the periphery of the dome. Hence when the dome is turned, the slot travels in an arcuate path. Projecting upwardly through slot 13 when the canteen is in its drinking mode is a short mouth tube 14 of flexible, soft plastic tubing, such as PVC or other material which may be maintained in a hygienic condition.

Figure 3:
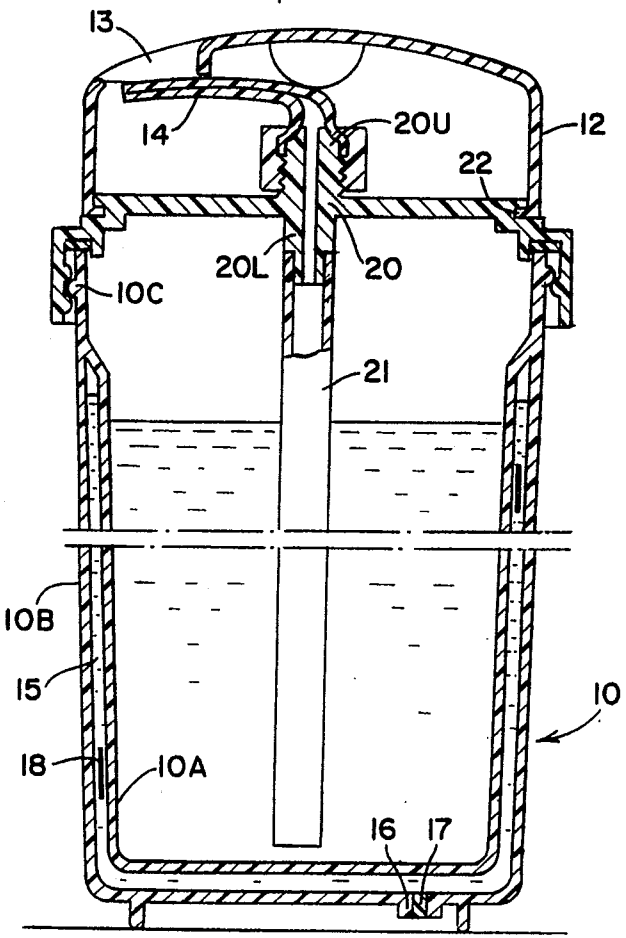
FIG. 3 is a longitudinal section taken through the canteen when in its sealing mode.

Container 10 is formed of transparent, synthetic plastic material of high strength such as acrylic resin, a thermoplastic polymer. As shown in FIG. 3, container 10 is constituted by an inner shell 10A concentric with an outer shell 10B, and an annular, externally-threaded rim 10C.

Inner shell 10A, whose upper edge is joined to outer shell 10B at the junction of the outer shell and rim 10C, is spaced from the outer shell to define a cylindrical chamber 15. This chamber is filled with a liquid carrier which is introduced into the chamber through a port 16 in the base of the outer shell, which port, after the chamber is filled, is then sealed by a thermoplastic closure 17.

Figure 4:
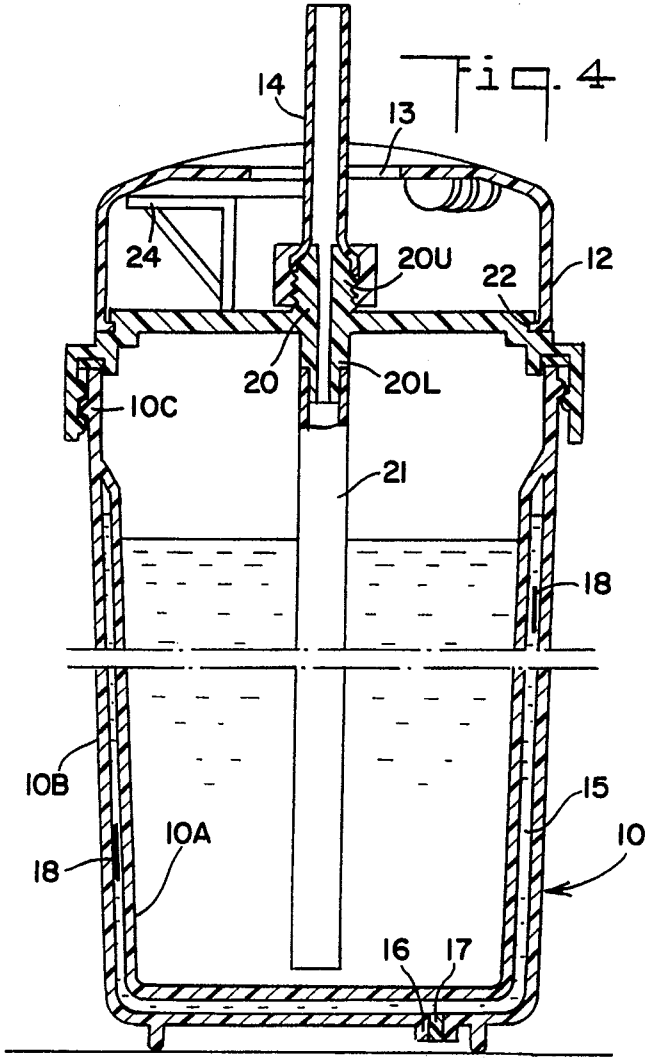
FIG. 4 is the same as FIG. 3, except that the canteen is in its drinking mode.

Dispersed in the liquid carrier filling chamber 15, as best seen in FIGS. 1 and 4, are decorative particles such as tiny, metallized pieces 18 of acetate film which have a silvery appearance, some of which are cut into miniature stars. Also dispersed in the liquid carrier, which preferably has anti-freeze properties so that it will not freeze in a cold climate, are miniature slippers 19. These stark and slippers are thematically related to artwork silk-screened or otherwise printed on the outer surface of inner shell 10A and visible through the outer shell.

This artwork takes the form of characters, fanciful vehicles or whatever other objects are involved in a well-known children's story or fairy tale. The reason, therefore, that stars and slippers are dispersed in the liquid carrier in chamber 15 is that the artwork appearing on the inner shell is related to the classic fairy tale of Cinderella. Hence the artwork may include the figure of the good fairy who, with her magic wand, which when waved emits glittering stars, summons up a horse-drawn, pumpkin-shaped carriage to take Cinderella to the ball, where she alone wears the glass slippers which fit no other candidate for the prince's hand in marriage. The handsome prince is seen dancing with Cinderella at the ball. When a child shakes the canteen, the particles dispersed in the liquid carrier are then animated to produce a dynamic display which brings the Cinderella story to life.

The decorative scheme described above is only by way of example, and in practice the story theme may be Aladdin, or involve Donald Duck or other DISNEY characters popular with children.

Mounted at the center on cover 11 is a coupler 20 whose projection below the cover forms a lower nipple 20L and whose projection above the top of the cover forms an upper nipple 20U. Attached to lower nipple 20N is a long dip tube 21 of flexible, synthetic plastic material, while attached to upper nipple 20U is the short mouth tube 14, which in the drinking mode of the canteen extends upwardly through slot 13 in dome 12, slot 13 then being in registration with the upper nipple.

Mouth tube 14, in combination with dip tube 21, creates a straw with which a child can siphon drinking water or other liquid from the container. Dip tube 21 extends to a point close to the bottom of inner shell 10A so that the child can siphon off almost all of the drinkable liquid within the container before it is necessary to replenish the supply by unscrewing cover 11 from the container and refilling it. Because of the double wall construction of the container, it provides thermal insulation to maintain liquid filling it in a hot or cold state for a prolonged period. Whether the liquid is hot or cold depends, of course, on its temperature when the container is filled.

As best seen in FIGS. 3, 4 and 7, formed on top of the cap-shaped cover 11 and concentric therewith is an annular channel 22 adapted to receive arcuate flanges 23 extending inwardly from the base of dome 12. The dome is fabricated of flexible, synthetic plastic material, such as polyethylene, so that it may be snapped onto the cover with its flanges then riding within annular channel 22 so that the dome is rotatable with respect to the cover.

Also anchored on the top of cover 11 is a bracket supporting a flat shutter element 24. The bracket is so positioned so that in the sealing mode of the canteen, shutter element 24 then blocks slot 13 in the dome, as shown in FIG. 5.

The rotatable dome is detented, so that it is turnable within a sector, one end of which represents the drinking mode position of the canteen, the other end, the sealing mode position.

Figure 6:
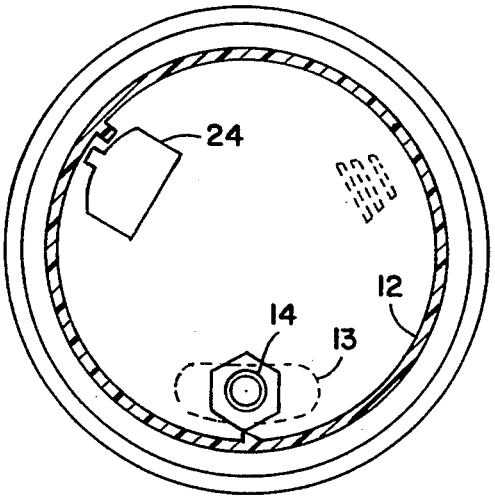
FIG. 6 illustrates this relationship in the drinking mode.

In the drinking mode position, as shown in FIG. 6, slot 13 in the dome is then in registration with the upper nozzle of the coupler, and the short mouth tube 14 then extends upwardly through the slot, so that the user can siphon water from the container.

Figure 5:
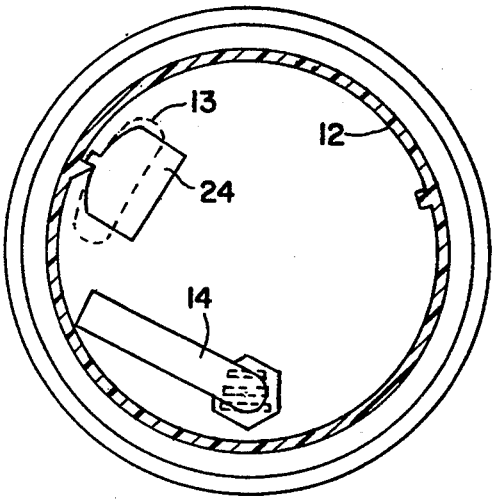
FIG. 5 illustrates the detented relationship between the cover and dome in the sealing mode of the container.

In the sealing mode position, which is illustrated in FIG. 5, the shutter element blocks slot 13 in dome 12 which is now out of registration with upper nipple 20U. In the sealing mode, no contaminants can enter the cover through the slot. In turning the dome from the drinking mode to the sealing mode position, this action causes mouth tube 14 to bend under the dome. The resultant bend 14B in the mouth tube acts to pinch off the tube to prevent the flow of liquid therethrough, so that now the mouth tube serves as a stopper, as shown in FIG. 3.

In practice, the outer shell of container 10 may have coupling rings or other appropriate plastic fixtures bonded at diametrically-opposed positions on plastic outer shell 10B below rim 10C. Attachable to these fixtures (not shown) are the ends of a shoulder strap or waist belt, so that the user may conveniently carry the canteen on his person.

Thus, a canteen in accordance with the invention is suitable for young children, for it incorporates in its structure a straw to siphon a drinkable liquid from the container, and all a child has to do to fill the container is to screw off the cover. And all a child has to do after drinking from the canteen is to turn the dome and thereby seal the container. And because the canteen is also a plaything, which when shaken produces a dynamic display, the child is induced to make frequent use of the canteen.

While there has been shown and described a preferred embodiment of a canteen for children in accordance with the invention, it will be appreciated that many changes and modifications may be made therein without, however, departing from the essential spirit thereof.

This mouth tube 14 is preferably made of medical grade silicone so that it is sterile and safe to put in the mouth. The mouth tube 14, one end of which is coupled to upper nipple 20U and secured thereto by a threaded nut, as shown in FIGS. 3 and 4, is preferably provided with an end shoulder that is engaged by the nut to strongly resist any force seeking to pull the mouth tube off the nipple. And-the liquid carrier filling chamber 15 is provided with an antibacterial agent and is non-toxic so that it is non-hazardous.

I claim:

1. A can teen that incorporates in its structure a straw that in a drinking mode of the canteen serves to siphon a drinkable liquid therefrom, and in a sealing mode serves as a stopper, said canteen comprising:

(a) a container for the liquid having a circular rim;

(b) a circular cover removably attached to the rim of the container, said cover being provided with an off-center coupler, said coupler having one end which projects from the underside of the cover having one end which projects from the underside of the cover to form a lower nipple, said coupler having another end projecting from the top of the cover to form an upper nipple;

(c) a long dip tube secured to the lower nipple and extending into the container;

(d) a short, flexible mouth tube secured to the upper nipple and forming in combination with the drip tube said straw; and (e) a dome mounted above the cover and provided with an off-center slot, said dome being turnable with respect to said cover from a drinking mode position in which the slot is in registration with the upper nipple and the mouth tube then extends upwardly through said slot, to a sealing mode position in which the mouth tube is bent under the dome and is pinched at its bend to serve as a stopper, said cover having anchored on its top a shutter element which when the dome is in said sealing mode position then blocks the slot in the dome.

2. A can teen as set forth in claim 1, in which the rim of the container is externally threaded and said cover is in a cap format and is screwed onto the rim.

3. A canteen as set forth in claim 2, wherein the top of said circular cover is provided with an annular channel concentric with the cover, and said dome is formed of flexible plastic material and is provided with an inwardly-extending arcuate flange that snaps into said channel, whereby the dome is turnable with respect to the cover.

4. A canteen as set forth in claim 1, wherein said container is formed of transparent, synthetic plastic material and includes a cylindrical inner shell concentric with a cylindrical outer shell to define a closed chamber that is filled with a liquid carrier having decorative elements dispersed therein, which when the canteen is shaken are then animated to provide a dynamic display.

5. A canteen as set forth in claim 4, wherein some of the decorative elements are metallized film glitter particles.

6. A canteen as set forth in claim 4, wherein said outer shell has a closable port therein, through which said liquid carrier is introduced into the chamber.

7. A canteen as set forth in claim 4, wherein said inner shell has an outer surface on which is printed artwork that is visible through the outer shell.

8. A canteen as set forth in claim 7, wherein said artwork includes characters from a fairy tale, some of said decorative particles being miniature shaped objects which are thematically related to the fairy tale.

9. A canteen as set forth in claim 8, wherein said fairy tale is Cinderella and said shaped objects are slippers.

* * * * *

UNITED STATES PATENT AND TRADEMARK OFFICE

CERTIFICATE OF CORRECTION

PATENT NO. : 5,339,982

DATED : August 23, 1994

INVENTOR(S) : Pierre Tardif

It is certified that error appears in the above-identified patent and that said Letters Patent is hereby corrected as shown below:

On the title page:
Inventor: "Pierre Tardie" substitute -- Pierre Tardif--.

Signed and Sealed this

Fifteenth Day of November, 1994

*Attest:*

Bruce Lehman

BRUCE LEHMAN

*Attesting Officer*

*Commissioner of Patents and Trademarks*